US010526794B2

(12) United States Patent
Garbelotto

(10) Patent No.: US 10,526,794 B2
(45) Date of Patent: Jan. 7, 2020

(54) JOINT FOR FLOORS IN STRIPS

(71) Applicant: PARCHETTIFICIO GARBELOTTO S.R.L., Cappella Maggiore (IT)

(72) Inventor: Antonio Garbelotto, Cappella Maggiore (IT)

(73) Assignee: PARCHETTIFICIO GARBELOTTO S.R.L., Cappella Maggiore (IT)

( * ) Notice: Subject to any disclaimer, the term of this patent is extended or adjusted under 35 U.S.C. 154(b) by 0 days.

(21) Appl. No.: 16/099,377

(22) PCT Filed: Jun. 29, 2017

(86) PCT No.: PCT/IB2017/053897

§ 371 (c)(1),
(2) Date: Nov. 6, 2018

(87) PCT Pub. No.: WO2018/002859

PCT Pub. Date: Jan. 4, 2018

(65) Prior Publication Data

US 2019/0203480 A1 Jul. 4, 2019

(30) Foreign Application Priority Data

Jun. 30, 2016 (IT) ..... 10201600067817

(51) Int. Cl.
*E04F 15/02* (2006.01)
*E04F 15/04* (2006.01)

(52) U.S. Cl.
CPC ..... *E04F 15/02038* (2013.01); *E04F 15/04* (2013.01); *E04F 2201/0146* (2013.01); *E04F 2201/042* (2013.01); *E04F 2201/0517* (2013.01)

(58) Field of Classification Search
CPC ..... E04F 15/02038; E04F 15/04; E04F 2201/042; E04F 2201/0146;
(Continued)

(56) References Cited

U.S. PATENT DOCUMENTS 6,070,374 A * 6/2000 Bifano ..... E04C 3/005 52/255
6,205,639 B1 * 3/2001 Pervan ..... B23P 11/00 29/509
(Continued)

FOREIGN PATENT DOCUMENTS

WO 9323636 A1 11/1993
WO 0127410 A1 4/2001
(Continued)

OTHER PUBLICATIONS

International Search Report dated Sep. 25, 2017 re: Application No. PCT/IB2017/053897, pp. 1-4.
(Continued)

*Primary Examiner* — Brian E Glessner
*Assistant Examiner* — Adam G Barlow
(74) *Attorney, Agent, or Firm* — Cantor Colburn LLP

(57) ABSTRACT

A joint for floors includes a series of strips, constituted by a single linear bar constituted by a central planar body from which multiple pairs of elastically deformable tabs protrude which can be associated selectively at adapted seats. The seats are provided in a lower region and longitudinally with respect to the strips and are adjacent to the longitudinal perimetric edges thereof. Each pair of the tabs is substantially S-shaped with the free end directed toward the outside of the planar body.

12 Claims, 6 Drawing Sheets

(58) Field of Classification Search
CPC ..... E04F 2201/0517; E04F 15/02044; E04F 2015/02116; E04F 2015/0205; E04F 15/02022; E04F 2015/02005; E04F 2015/0211; E04F 2015/0266
USPC ..... 52/582.1, 584.1, 591.4, 591.5, 509, 52/506.05, 592.1
See application file for complete search history.

(56) References Cited

U.S. PATENT DOCUMENTS 6,233,886 B1 * 5/2001 Andres ..... E01C 5/005 114/267
6,339,908 B1 * 1/2002 Chuang ..... E04F 15/04 52/177
6,446,405 B1 * 9/2002 Pervan ..... E04F 15/102 52/403.1
6,453,632 B1 * 9/2002 Huang ..... E04F 15/04 52/385
6,510,665 B2 * 1/2003 Pervan ..... E04F 15/02 52/589.1
6,550,206 B2 * 4/2003 Lee ..... E04F 15/04 52/403.1
7,051,486 B2 * 5/2006 Pervan ..... E04F 15/04 52/177
7,805,903 B2 * 10/2010 Liu ..... E04F 15/04 52/489.1
8,006,458 B1 * 8/2011 Olofsson ..... E04F 15/02 52/489.1
8,276,343 B2 * 10/2012 Yang ..... E04F 15/02 52/509
9,416,546 B2 * 8/2016 Claudin ..... E04F 15/02022
9,890,543 B2 * 2/2018 Aquilani ..... E04F 13/0835
2001/0010139 A1 * 8/2001 De Kerpel ..... E04B 9/26 52/479
2003/0115821 A1 * 6/2003 Pervan ..... E04F 15/02 52/578
2004/0020153 A1 * 2/2004 Huang ..... E04F 15/02033 52/582.1
2005/0204677 A1 * 9/2005 Mei ..... E04F 15/04 52/582.1
2006/0179754 A1 * 8/2006 Yang ..... E04F 15/02 52/426
2007/0151189 A1 * 7/2007 Yang ..... E04F 15/02 52/582.2
2008/0168730 A1 * 7/2008 Pervan ..... E04C 2/20 52/313
2008/0216434 A1 * 9/2008 Pervan ..... B27F 1/02 52/584.1
2009/0071090 A1 * 3/2009 Yang ..... E04F 15/02 52/588.1
2009/0094925 A1 * 4/2009 Andres ..... E04F 15/02 52/511
2009/0107076 A1 * 4/2009 Kim ..... E04F 15/02 52/582.1
2014/0013698 A1 * 1/2014 Schoneveld ..... E04F 15/02005 52/582.1
2014/0305064 A1 10/2014 Baker et al.
2015/0059271 A1 * 3/2015 Tsai ..... E04F 15/02194 52/302.1
2016/0060880 A1 * 3/2016 Stover ..... E04F 15/02044 52/582.2
2017/0314591 A1 * 11/2017 Baker ..... F16B 5/002

FOREIGN PATENT DOCUMENTS

WO WO 2012159162 * 11/2012
WO 2015005860 A1 1/2015

OTHER PUBLICATIONS

Written Opinion dated Sep. 25, 2017 re: Application No. PCT/IB2017/053897, pp. 1-8.

* cited by examiner

JOINT FOR FLOORS IN STRIPS

TECHNICAL FIELD

The present disclosure relates to a joint for floors in strips.

BACKGROUND

Currently it is known to provide floors by using strips or slats made of wood which are provided laterally with adapted tabs and complementarily shaped seats in order to allow their stable mutual connection when they are arranged mutually adjacent.

However, the provision of these floors has drawbacks, which include the fact that since adhesives are used for the stable connection of the strips, one obtains a floor that cannot be inspected and, if it is necessary to intervene to replace one or more damaged panels, one is forced to remove them and it is impossible to reconnect them as they were originally unless the entire floor is removed.

Furthermore, the use of adhesives worsens the healthiness of the environment in which the floor is installed and further requires, once installed, time so that it can be used, since one must wait for the adhesive to dry.

US2014/305064 is also known which describes a plurality of auxiliary connectors or clips for floors in strips; particular, one of the illustrated constructive solutions describes an auxiliary connector or clip that is constituted by a central supporting element from which two pairs of double wings, which are symmetrical to the vertical axis of said support, extend.

Each wing has a substantially linear shape with a tooth that protrudes and is oriented respectively toward the inside or the outside of the supporting element.

This auxiliary connector is adapted to perform only the function of a mere local connection, in order to define a reference region for the installer for the interconnection of another panel, and does not ensure the fixing of the panels or the stability of its position once installed; accordingly, the panels 14 tend, over time, to rise from the ground and create differences in level.

Furthermore, with this solution one obtains an auxiliary connector that cannot be removed in the course of time, since its position is not visible to the installer once the floor has been provided, forcing the operator to remove the entire floor in case of intervention on a single auxiliary connector.

A further drawback resides in that in order to join two adjacent panels it is necessary to use a plurality of connectors or clips which must be arranged in any point (which cannot be predetermined constantly) of the panel, increasing coupling times and preventing removability.

WO01/27410 is also known which describes a floor composed of a series of tongue and groove boards the longitudinal surfaces of which are mutually connected by means of the tongues and grooves that are present thereat and of two first U-shaped clips and the transverse surfaces of which are mutually connected by means of the tongues and grooves that are present thereat and by means of second U-shaped clips.

The function of the joints is therefore only to keep the boards mutually adjacent and therefore said joints are unable to ensure their fixing or the stability of the joints once installed.

A further drawback resides in that the presence of tongues and grooves on the longitudinal surfaces and on the transverse surfaces does not allow to remove or replace the boards individually, without disassembling the entire floor; in addition, the tongues and grooves produce, due to the type of connection that they allow to achieve, great friction between the surfaces that make mutual contact, in practice making it impossible to remove a single board.

Another drawback that is observed in the background art resides in the system for assembling the boards, which requires the use of different elements, such as the tongues and grooves of the boards and at least three clips, through numerous steps which render the coupling long and laborious.

In particular, it is necessary to install the clips on the lower surface of the board so that both the leg of the first clip and the leg of the second clip engage the seat of the board, while the leg of the first clip and the leg of the second clip extend beyond the longitudinal edge of the board.

The longitudinal surface of the board is then arranged parallel to the longitudinal surface of the board so that the leg of the clip engages the seat of the board and the tongues and grooves of the board engage the tongues and grooves of the board.

The second clip is then installed on the lower face of the panel so that the leg of the second clip engages the seat and so that the leg of the second clip extends beyond the end of the board.

The transverse surface of the board is then arranged parallel the transverse surface of the board so that the leg of the clip engages the seat of the board and the tongues and grooves of the board engage the tongues and grooves of the board and at the same time the longitudinal surface of the board is arranged parallel to the longitudinal surface of the board so that the leg of the clip engages the seat of the board and so that the tongues and grooves of the board engage the tongues and grooves of the board.

Finally, the boards are hammered into position.

SUMMARY

The aim of the present disclosure is therefore to solve the described technical problems, eliminating the drawbacks of the cited background art and thus providing an disclosure that allows to provide floors in strips that can be installed in a short time and without using adhesives.

Within this aim, the disclosure allows even individual strips to be replaced in a short time and easily.

The disclosure allows to fix, firmly and by itself, two strips, ensuring the stability of its position, once it is installed.

The disclosure allows to reduce the noise that is typical of a floating or raised floor.

The disclosure provides an effective and structurally simple device with modest manufacturing costs, and that can be provided with usual known systems.

This aim and these advantages, as well as others which will become better apparent hereinafter, are achieved by providing a joint for floors constituted by a series of strips, characterized in that it is constituted by a single linear bar constituted by a central planar body from which multiple pairs of elastically deformable tabs protrude which can be associated selectively at adapted seats provided in a downward region and longitudinally with respect to said strips and adjacent to the longitudinal perimetric edges thereof each pair of said tabs being substantially S-shaped with the free end directed toward the outside of said planar body.

BRIEF DESCRIPTION OF THE DRAWINGS

Further characteristics and advantages of the disclosure will become better apparent from the detailed description of a particular but not exclusive embodiment, illustrated by way of nonlimiting example in the accompanying drawings, wherein.

DETAILED DESCRIPTION OF THE DRAWINGS

Figure 1:
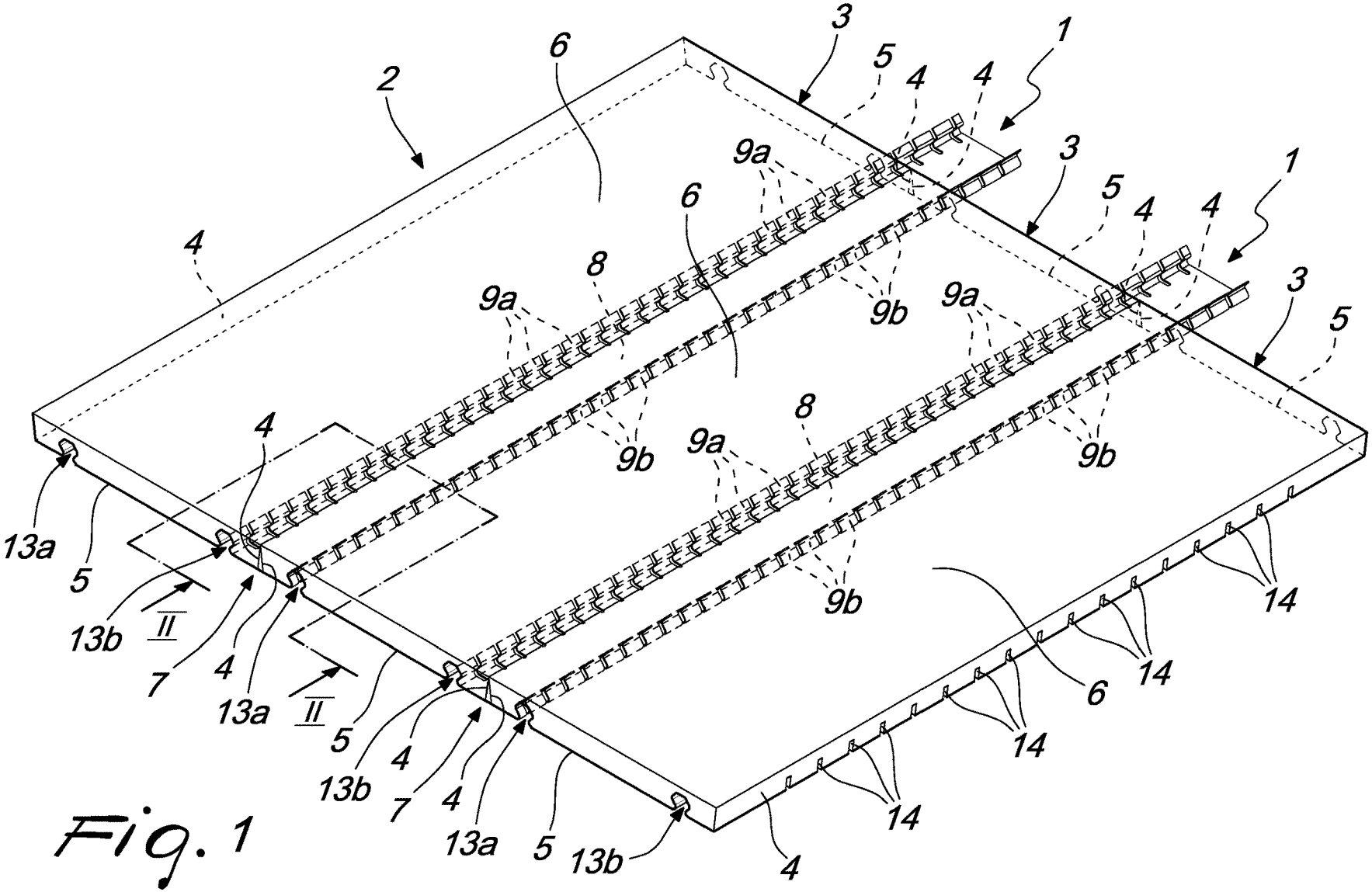
FIG. 1 is a perspective view, taken laterally and from above, of the joint applied to strips.
Figure 2A:
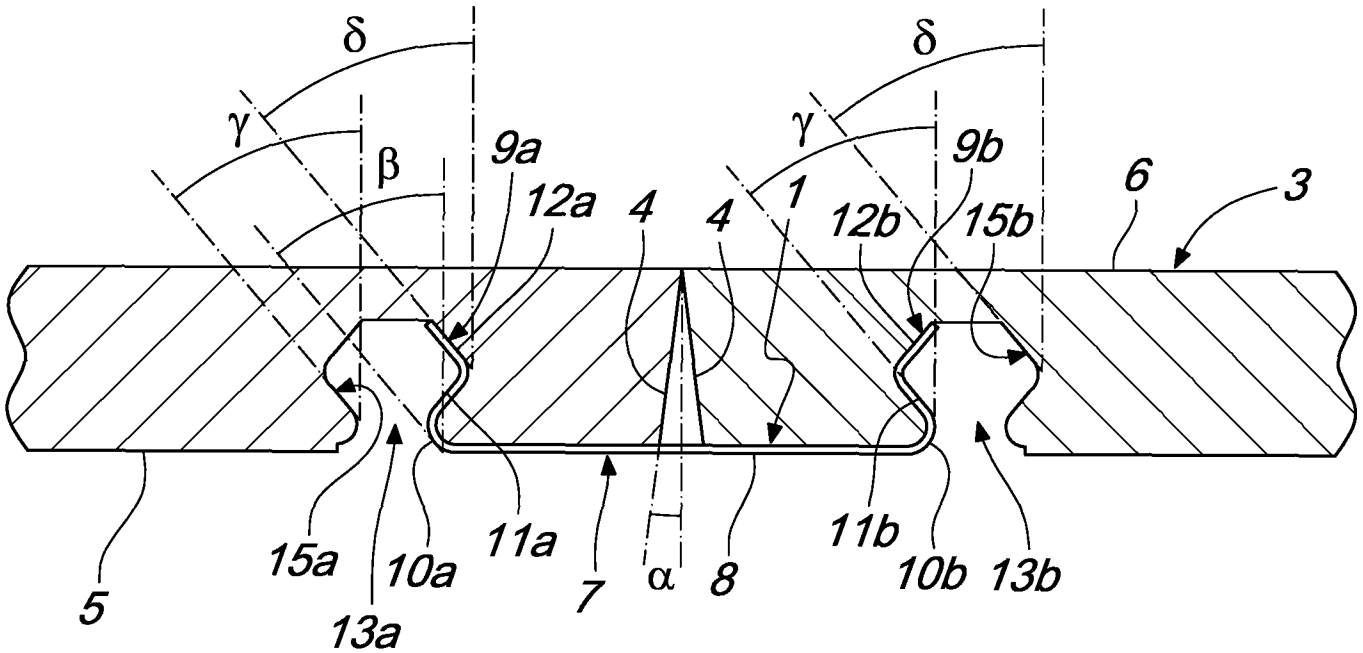
FIGS. 2*a* and 2*b* are partially sectional views of the joint applied to strips, taken along the sectional plane II-II of FIG. 1.
Figure 2B:
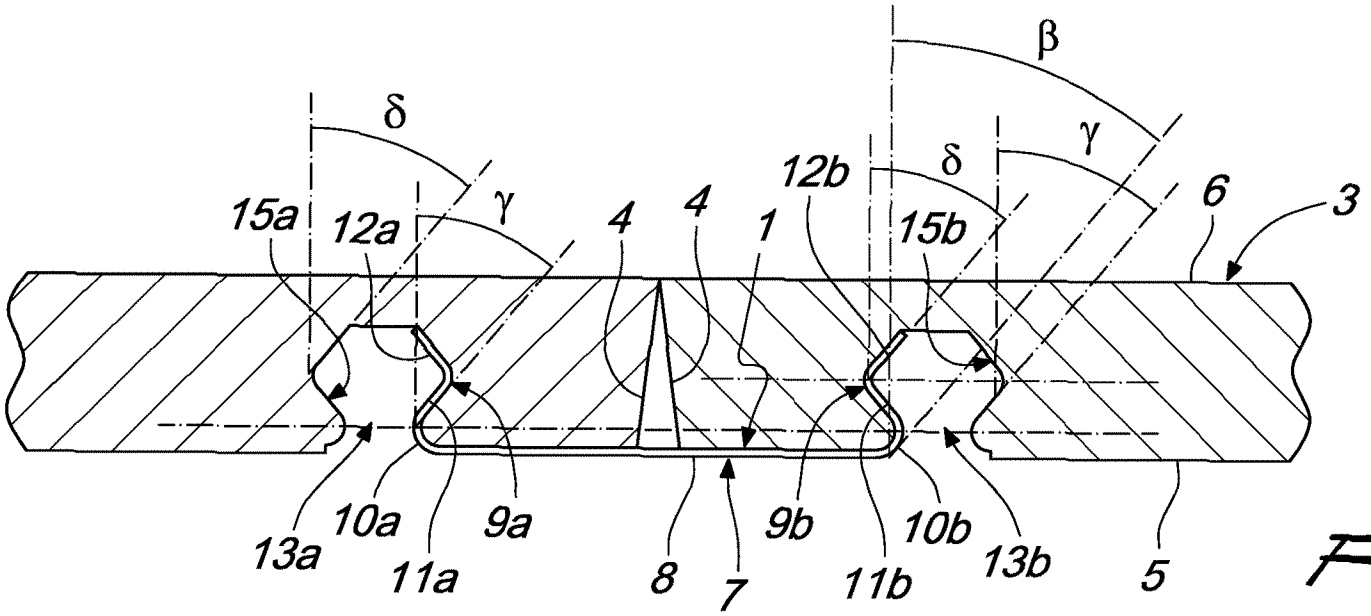
Figure 3:
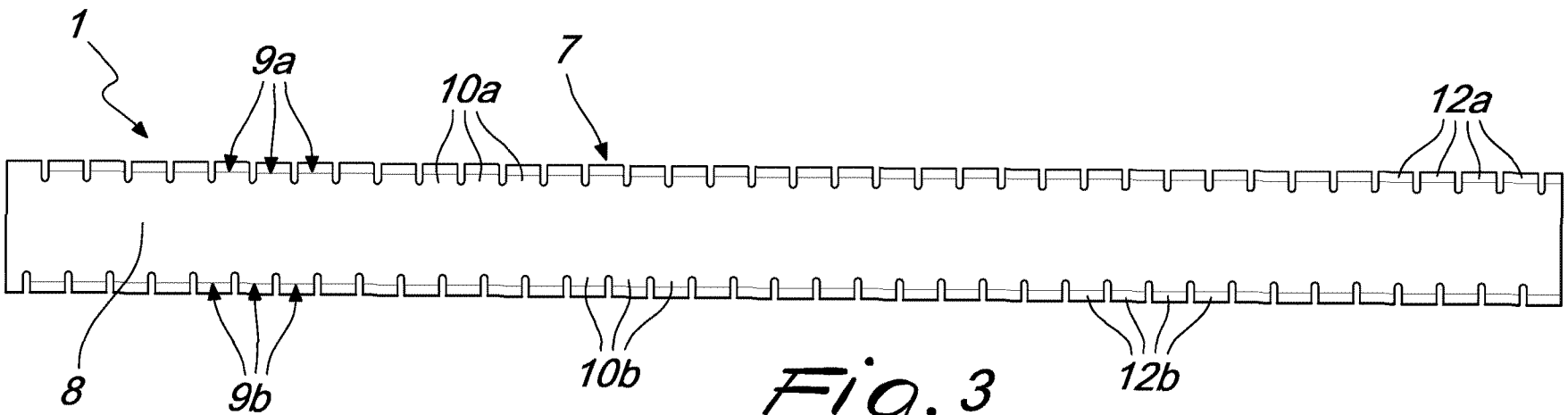
FIG. 3 is a top view of the joint.
Figures 4, 5:
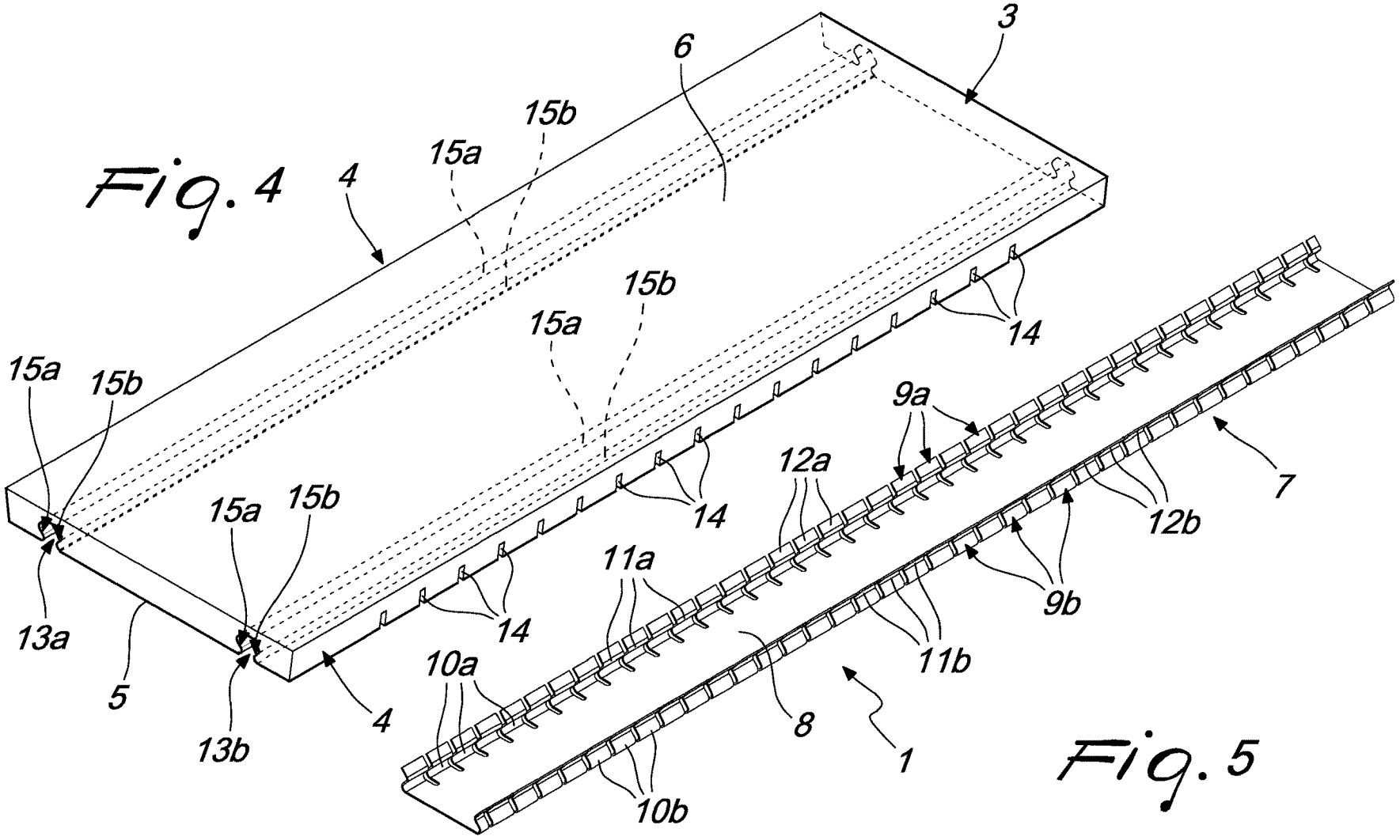
FIG. 4 is a perspective view, taken laterally and from above, of a strip.
FIG. 5 is a perspective view, taken laterally and from above, of a joint.
Figure 6:
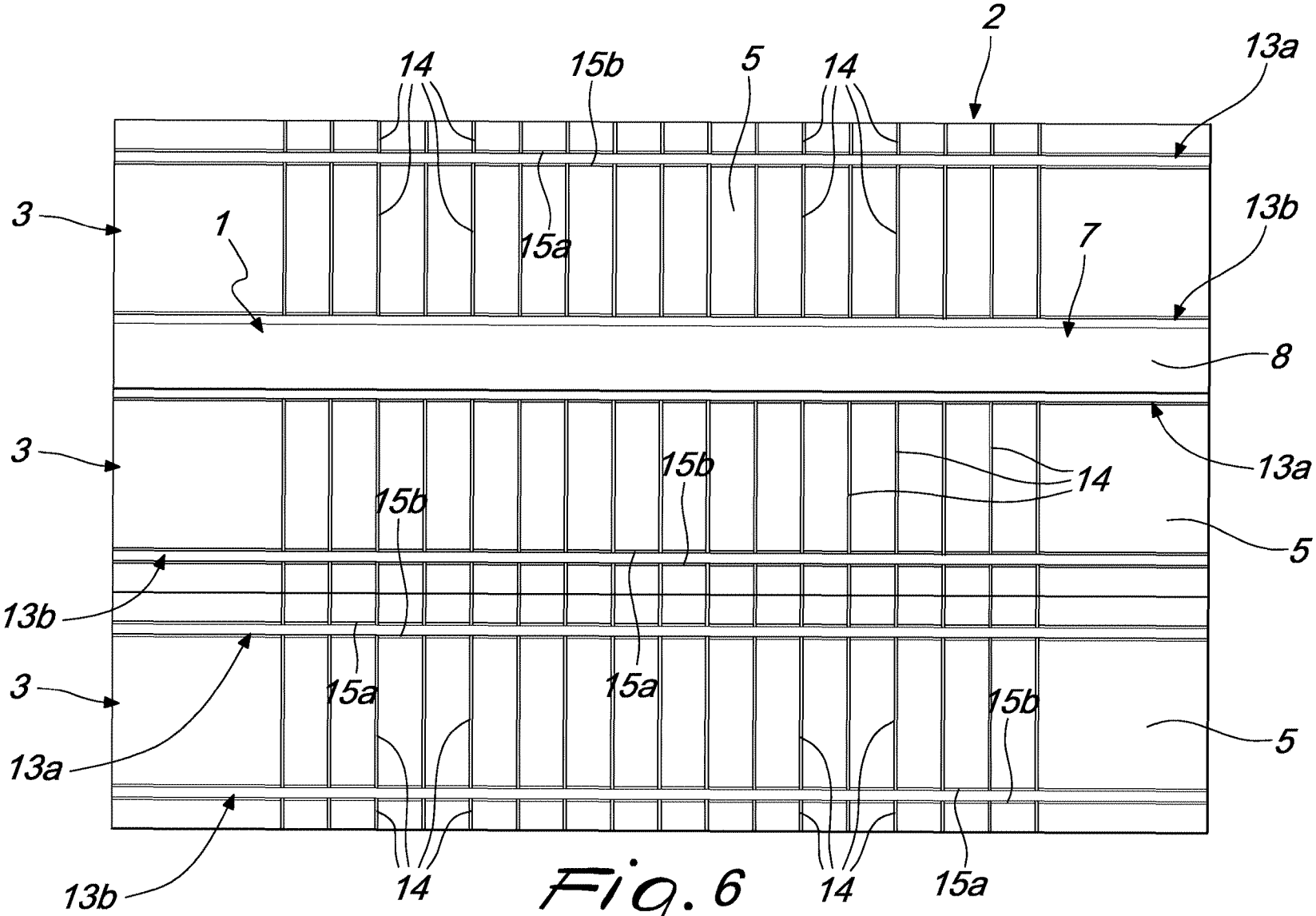
FIG. 6 is a bottom view of the joint applied to strips.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

With reference to FIGS. 1-7, the reference numeral 1 designates a joint for floors 2 constituted by a series of strips 3, made of solid wood or not, which are substantially shaped like a parallelepiped with a polygonal, preferably rectangular, base, which can be arranged mutually adjacent.

In the constructive solution shown from FIG. 1 to FIG. 6, the strips 3 substantially have longitudinal perimetric edges 4, which are planar and slightly inclined by an angle α (alpha) with respect to the vertical and such as to define a width of the lower surface 5 that is narrower than the corresponding width of the upper surface 6.

Figure 7:
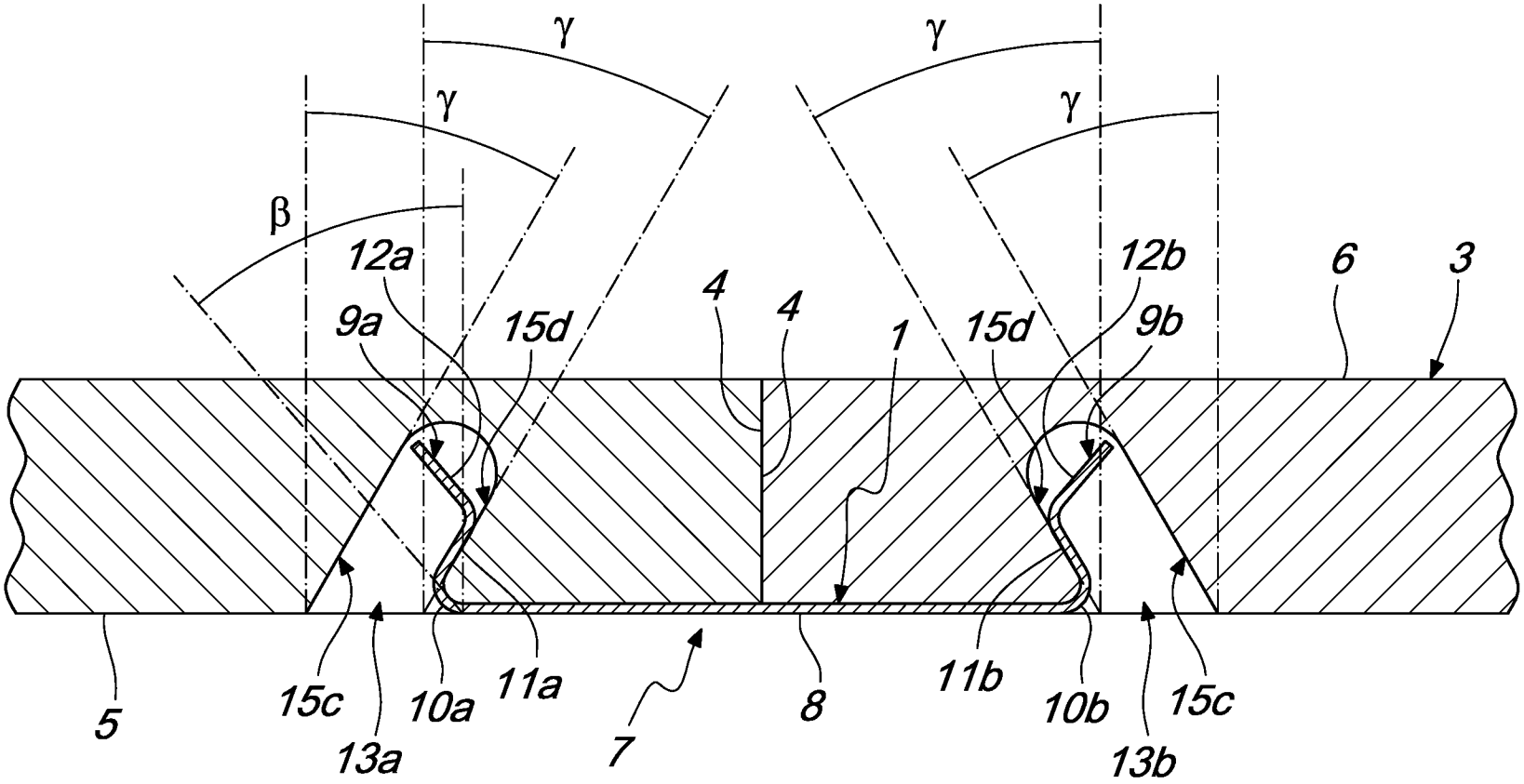
FIG. 7 is a view, similar to FIGS. 2*a* and 2*b*, of the joint applied to a constructive variation of the strips.

In the constructive solution shown in FIG. 7, the strips 3 are provided with planar and vertical longitudinal perimetric edges 4, such as to define a width of the lower surface 5 that is identical to the corresponding width of the upper surface 6.

The joint 1 is constituted by a single linear bar 7, preferably but not exclusively made of metallic material, which has a substantially C-shaped cross-section of the chosen length.

The bar 7 is thus constituted by a central planar body 8, which has a substantially rectangular shape and from the longitudinal perimetric edges of which protrude, in the same direction, multiple pairs of elastically deformable tabs 9*a*, 9*b*, which are arranged along a same axis that is substantially perpendicular to the central planar body 8.

Each pair of tabs 9*a*, 9*b* is substantially S-shaped with the free end directed toward the outside of the planar body 8.

The shape of each pair of tabs 9*a*, 9*b* can be the most appropriate as a function of specific requirements, such as the type or size or the material that constitute the strip 3 that is used.

In the particular embodiment shown from FIG. 1 to FIG. 6, each tab 9*a*, 9*b* is constituted by a first portion 10*a*, 10*b*, which is substantially arc-like, provides blending with the planar body 8 and protrudes toward the outside of the planar body 8 according to a constant initial inclination that has an angle β (beta) substantially of approximately (55°)±10°, preferably approximately 65° C., considering a rotation that starts from a plane that is perpendicular to the planar body 8 toward the outside of the planar body 8.

Each one of the tabs 9*a*, 9*b* is constituted further by a second portion 11*a*, 11*b*, which is contiguous and is blended with the respective first portion 10*a*, 10*b*, which protrudes and is directed toward the inside of the planar body 8 according to a constant inclination that has an angle γ (gamma) of preferably approximately 45°±10°, considering a rotation that starts from a plane that is perpendicular to the planar body 8 toward the inside of the planar body 8.

Each one of the tabs 9*a*, 9*b* is constituted further by a third portion 12*a*, 12*b*, which is contiguous to and blended with the respective second portion 11*a*, 11*b*, which protrudes toward the outside of the planar body 8 according to a constant inclination that has an angle δ (delta) preferably of approximately 55°±10° with respect to a plane that is perpendicular to the planar body 8 toward the outside of the planar body 8.

Each strip 3 has, at the lower surface 5 and proximate to each one of its longitudinal perimetric edges 4, at least one seat 13*a*, 13*b*.

In the particular embodiment shown from FIG. 1 to FIG. 6, the seats 13*a*, 13*b* are mutually identical and are shaped substantially complementarily to the shape of the first, second, and third portions 10*a*, 10*b*, 11*a*, 11*b*, 12*a*, 12*b*, so as to allow the insertion and temporary accommodation of the tabs 9*a*, 9*b* adjacent to the resting surfaces of the first, second, and third portions 10*a*, 10*b*, 11*a*, 11*b*, 12*a*, 12*b*.

Each seat 13*a*, 13*b* then has two side walls 15*a*, 15*b* which substantially follow in sequence the tilt of the angles β (beta), γ (gamma) and δ (delta), the seats 13*a*, 13*b* being shaped complementarily to the tabs 9*a*, 9*b*.

The side walls 15*a*, 15*b* of each seat 13*a*, 13*b* are mutually spaced by a space that is sufficient to allow the elastic deformation of the tabs 9*a*, 9*b* during their insertion/removal.

In the particular embodiment shown in FIG. 7, each seat 13*a*, 13*b* is provided with two side walls 15*c*, 15*d* each of which is slightly inclined by a same angle that is substantially parallel to the angle γ (gamma) of the second portions 11*a*, 11*b* of the tabs 9*a*, 9*b*, the side walls 15*c*, 15*d* being substantially parallel to each other and being blended by a preferably curved upper wall.

The seats 13*a*, 13*b* are arranged, with respect to the planar and vertical longitudinal perimetric edges 4, so that they are mutually opposite.

The side wall 15*d* has a first initial part that is shaped complementarily to the first and second portions 10*a*, 10*b*, 11*a*, 11*b* of the tabs 9*a*, 9*b* of the corresponding joints 1 and has a constant initial inclination that has an angle β (beta).

The walls 15*c*, 15*d* are mutually spaced by a space that is sufficient to allow the elastic deformation of the tabs 9*a*, 9*b* during their insertion/removal; this space is substantially slightly larger than the length of the third portions 12*a*, 12*b*.

In all of the illustrated embodiments, the width of the joint 1 is substantially equal to twice the distance between a longitudinal perimetric edge 4 of the strip 3 and the adjacent seat 13*a*, 13*b*: essentially, the overall width of the joint 1 is such that its arrangement below the strip 3 causes the tabs 9*a*, 9*b* to arrange themselves at the seats 13*a*, 13*b* of two strips 3 once they are arranged next to each other.

Furthermore, the thickness of the planar body 8 of the joint 1 can be accommodated or not within an adapted cavity provided in the lower surface 5 of each strip 3 in the region from the seats 13*a*, 13*b* to the longitudinal perimetric edges 4.

The shape of the seats 13*a*, 13*b* and of the tabs 9*a*, 9*b* is such that the latter can be inserted in the seats 13*a*, 13*b* by virtue of an elastic deformation that can be imparted outward to the third portions 12*a*, 12*b* during their insertion in the seats 13*a*, 13*b*.

The shape of the tabs 9*a*, 9*b* is such that once they are inserted in the seats 13*a*, 13*b* their return to the initial shape entails a removable vise-like mechanical locking with respect to the seats 13*a*, 13*b*.

At the lower surface 5 of each strip 3 there is a plurality of transverse and mutually parallel slots 14, which are extended along the entire width of the strip 3 and are adapted to increase the flexibility of the strips 3.

In its use, therefore, a series of appropriately mutually spaced joints 1 is laid initially, on the base of the floor 2: the various strips 3 are then associated with each one of them, arranging the tabs 9*a* within the seat 13*b* of a strip 3 and the tabs 9*b* within the seat 13*a* of a distinct and adjacent strip 3.

It is in fact sufficient to apply a slight pressure to each strip 3 in order to achieve coupling with a joint 1; the mutual uncoupling of the two is equally simple and quick.

The elastic deformation that can be imparted during coupling by the tabs 9*a*, 9*b* forces, once they are accommodated within the seats 13*a*, 13*b*, the vise-like connection of two adjacent strips 3, which are thus stably arranged mutually adjacent; the possible presence of the slightly inclined shape of the longitudinal perimetric edges 4 allows to compensate for any tolerances of the strips.

In practice it has been found that the disclosure has achieved the intended aim and objects, a joint 1 having been obtained which allows to provide floors 2 in strips 3 that can be installed in a short time and without using adhesives, thus obtaining floating and raised floors 2 which can be walked on immediately after laying, since there is no need to wait for adhesive drying times.

Furthermore, the absence of adhesives during the step of assembly of the floor 2 ensures a healthy environment that is free from substances that are harmful for the user.

It has also been observed that the joint 1 allows to provide floors 2 that are obtained simply by arranging mutually side by side individual strips 3, which can further be removed or replaced, even individually, in a short time and easily without having to disassemble the entire floor 2.

Furthermore, it has been observed that the joint 1 is capable of ensuring on its own the stable fixing of two strips 3, once installed, since the pair of tabs 9*a*, 9*b*, by virtue of their substantially S-shaped configuration, creates a force that pushes the strips 3 downward, keeping all the strips 3, which contribute to form the floor 2, joined and keeping them firmly rested on the ground.

Furthermore, it has been observed that the disclosure allows to reduce the noise of a floating or raised floor by means of the complete resting of the lower surface 5 of the strips 3 that constitute the floor 2 on the supporting base.

Furthermore, the supporting base can be made of any material, and this makes the disclosure applicable also to buildings being renovated.

The plurality of slots 14 extended along the entire width of the lower surface 5 of the strip 3 increases the flexibility of the strips 3.

The joint 1 is structurally simple and has modest manufacturing costs.

The materials used, as well as the dimensions that constitute the individual components of the disclosure, may of course be more pertinent according to the specific requirements.

The various means for performing certain different functions need not certainly coexist only in the illustrated embodiment but can be present per se in many embodiments, including ones that are not illustrated.

The characteristics indicated as advantageous, convenient, or the like may also be omitted or be replaced with equivalents.

The disclosures in Italian Patent Application no. 102016000067817 (UA2016A004777), from which this application claims priority, are incorporated herein by reference.

The invention claimed is:

1. A joint for floors constituted by a series of strips, comprising a single linear bar constituted by a central planar body from which multiple pairs of elastically deformable tabs protrude which can be associated selectively at seats provided in a lower region and longitudinally with respect to said strips and adjacent to the longitudinal perimetric edges thereof, each pair of said tabs being substantially S-shaped with the free end directed toward the outside of said planar body, the shape of the tabs being such that once said tabs are inserted in the seats their return to the initial shape entails a removable mechanical locking with respect to the seats, said elastic deformation imparted during coupling by the tabs forces, once they are accommodated within the seats, a connection of two adjacent strips wherein each one of said tabs is constituted by a first portion, a second portion, and a third portion, wherein the second portion is contiguous to and blended with said first portion and wherein the third portion is contiguous to and blended with said second portion and protrudes toward the outside of said planar body according to a constant inclination that has an angle δ (delta) of substantially 55°±10° with respect to a plane that is perpendicular to said planar body and is oriented toward the outside of said planar body.

2. The joint according to claim 1, wherein at a lower surface of said strips there are one or more mutually parallel slots, which are transverse to said strips, extended along the entire width of said strip, and are adapted to increase the flexibility of said strips.

3. The joint according to claim 1, wherein said strips, which can be arranged mutually adjacent, have substantially the shape of a parallelepiped with a polygonal base, which has substantially said longitudinal perimetric edges which are planar and slightly inclined by an angle α (alpha) with respect to the vertical and such as to define a width of a lower surface of said strips that is smaller than the corresponding width of the upper surface of said strips.

4. The joint according to claim 3, wherein said strips, which can be arranged mutually adjacent, have substantially the shape of a parallelepiped with a polygonal base, in which said longitudinal perimetric edges are planar and vertical, said strips having a width of the lower surface that is equal to the corresponding width of the upper surface.

5. The joint according to claim 1, wherein said single linear bar has a substantially C-shaped cross-section, said bar being constituted by said central planar body, which has a substantially rectangular shape and from longitudinal perimetric edges of which protrude, in the same direction, the plurality of pairs of said elastically deformable tabs, which are arranged along a same axis that is substantially perpendicular to said central planar body.

6. The joint according to claim 1, wherein the first portion is substantially arc-shaped and for blending with said planar body and protrudes toward the outside of said planar body according to an initial constant inclination that has an angle β (beta) substantially of 55°±10°, considering a rotation that starts from a plane that is perpendicular to said planar body and is oriented toward the outside of said planar body.

7. The joint according to claim 6, wherein the second portion protrudes and is directed toward the inside of said planar body according to a constant inclination that has an angle γ (gamma) of substantially 45°±10°, considering a rotation that starts from a plane that is perpendicular to said planar body and is oriented toward the inside of said planar body.

8. The joint according to claim 1, wherein each strip has, at said lower surface and proximate to each one of said longitudinal perimetric edges, two mutually identical seats, the shape of each of which is substantially complementary to the shape of said first, second, and third portions, so as to allow the insertion and accommodation of said tabs adjacent to the resting surfaces of said first, second, and third portions, each seat having two side walls which follow substantially sequentially the tilt of said angles β (beta), γ (gamma) and δ (delta), said seats being shaped complementarily to said tabs), said side walls being mutually spaced by a space that is sufficient to allow the elastic deformation of said tabs during their insertion/removal.

9. The joint according to claim 1, wherein each strip has, at said lower surface and proximate to each one of said longitudinal perimetric edges, at least one seat provided with two side walls, each slightly inclined by a same angle that is substantially parallel to said angle γ (gamma) of said second portions of said tabs, said side walls being substantially mutually parallel and being blended by a curved upper wall, said seats being arranged mutually opposite with respect to said planar longitudinal perimetric edges, said side wall having a first initial part that is shaped complementarily to said first and second portions of said tabs and having an initial constant inclination that has an angle β (beta), said walls being mutually spaced by a space that is sufficient to allow the elastic deformation of said tabs during their insertion/removal, said space being larger than the length of said third portions.

10. The joint according to claim 8, wherein the shapes of said seats and of said tabs are such that the latter can be inserted in said seats by virtue of an elastic deformation that can be imparted outward to said third portions during their interaction with said side walls, the shape of said tabs being such that once they are inserted in said seats their return to the initial shape entails a removable mechanical locking with respect to said seats.

11. The joint according to claim 9, having a width that is substantially equal to twice a distance between one of said longitudinal perimetric edges of said strip and said adjacent seat, said overall width of said joint being such that its arrangement below said strip causes said tabs to arrange themselves at said side walls of said seats of two of said strips once they are arranged next to each other.

12. The joint according to claim 9, wherein a series of said joints, mutually spaced, is adapted to be arranged on the base of said floor and each one of said joints is adapted to be associated with said strips, forcing said tab within said seat of one of said strips and said tab within said seat of one of said distinct and adjacent strips and applying a slight pressure to each one of said strips in order to achieve removable elastic coupling to said joint, the elastic deformation that can be imparted, during coupling, by said tabs forcing, once they are accommodated within said seats, a connection of two adjacent said strips, which are thus arranged stably mutually adjacent, an inclination of said longitudinal perimetric edges allowing to compensate for any tolerances of said strips.

* * * * *